US008430532B2

(12) United States Patent
Lee et al.

(10) Patent No.: US 8,430,532 B2
(45) Date of Patent: Apr. 30, 2013

(54) LED LAMP HAVING A HEAT-DISPERSING UNIT

(75) Inventors: Chung-En Lee, Taipei (TW); Hung-Ming Liu, Taipei (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 250 days.

(21) Appl. No.: 12/859,508

(22) Filed: Aug. 19, 2010

(65) Prior Publication Data

US 2012/0044687 A1 Feb. 23, 2012

(30) Foreign Application Priority Data

Apr. 29, 2010 (CN) ..... 2010 1 0161800

(51) Int. Cl.
*F21V 29/00* (2006.01)

(52) U.S. Cl.
USPC ..... 362/294; 362/373

(58) Field of Classification Search ..... 362/294, 362/373, 547
See application file for complete search history.

(56) References Cited

U.S. PATENT DOCUMENTS

| | | | | |
|---|---|---|---|---|
| 7,547,124 | B2 * | 6/2009 | Chang et al. | 362/373 |
| 7,967,473 | B2 * | 6/2011 | Huang et al. | 362/294 |
| 2011/0063832 | A1 * | 3/2011 | Hu et al. | 362/235 |

* cited by examiner

*Primary Examiner* — Robert May
(74) *Attorney, Agent, or Firm* — Rosenberg, Kleni & Lee

(57) ABSTRACT

An LED lamp includes a lamp seat and a light assembly. The lamp seat includes a heat-dispersing unit having a plurality of tubular members extending in a horizontal direction and disposed in a side-by-side manner. Each of the tubular members defines a tubular space. The light assembly includes a light module having an LED element. The light module is mounted directly or indirectly on the tubular members of the heat-dispersing unit.

13 Claims, 6 Drawing Sheets

LED LAMP HAVING A HEAT-DISPERSING UNIT

CROSS-REFERENCE TO RELATED APPLICATION

This application claims priority of Chinese Application No. 201010161800.3, filed on Apr. 29, 2010.

BACKGROUND OF THE INVENTION

1. Field of the Invention

The present invention relates to a lamp, and more particularly, to an LED (light-emitting diode) lamp having a good heat-dissipating structure.

2. Description of the Related Art

An LED has the advantages of high efficiency, long life, and low power consumption. LEDs have been gradually replacing traditional light bulbs in recent years. Examples of such replacement include use of LEDs in lighting apparatuses, in backlight modules for display devices, as well as in streetlights.

LEDs experience a drop in efficiency as temperature is increased. Hence, in LED lamps where a plurality of LEDs are used together, good heat dissipation is necessary to maintain high efficiency.

Taiwanese Utility Model Patent No. 368014 discloses a structure for an LED street light assembly, in which a fin structure is used for heat-dissipation purposes.

SUMMARY OF THE INVENTION

It is an object of the present invention to provide an LED lamp including a heat-dissipating structure that effectively minimizes the heat generated by the LED lamp through use of a simple, low cost, and easy-to-assemble configuration.

According to one aspect, the LED lamp of this invent ion comprises a lamp seat and a light assembly.

The lamp seat includes a heat-dispersing unit having a plurality of tubular members extending in a horizontal direction and disposed in a side-by-side manner. Each of the tubular members defines a tubular space.

The light assembly includes a light module having an LED element. The light module is mounted directly or indirectly on the tubular members of the heat-dispersing unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
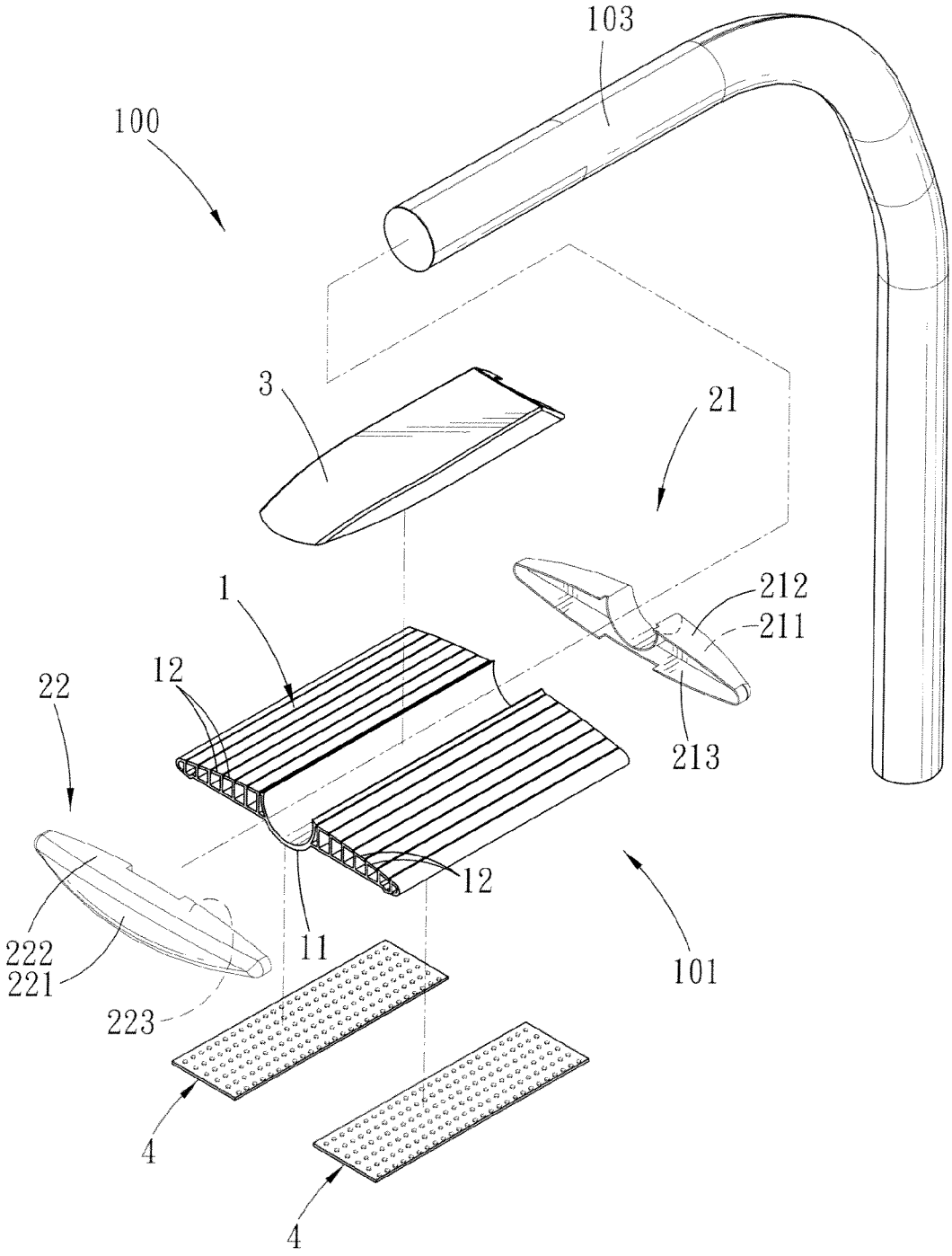
FIG. 1 is an exploded perspective view of an LED lamp according to a first preferred embodiment of the present invention.

Before the present invention is described in greater detail with reference to the accompanying preferred embodiments, it should be noted herein that like elements are denoted by the same reference numerals throughout the disclosure.

Figure 2:
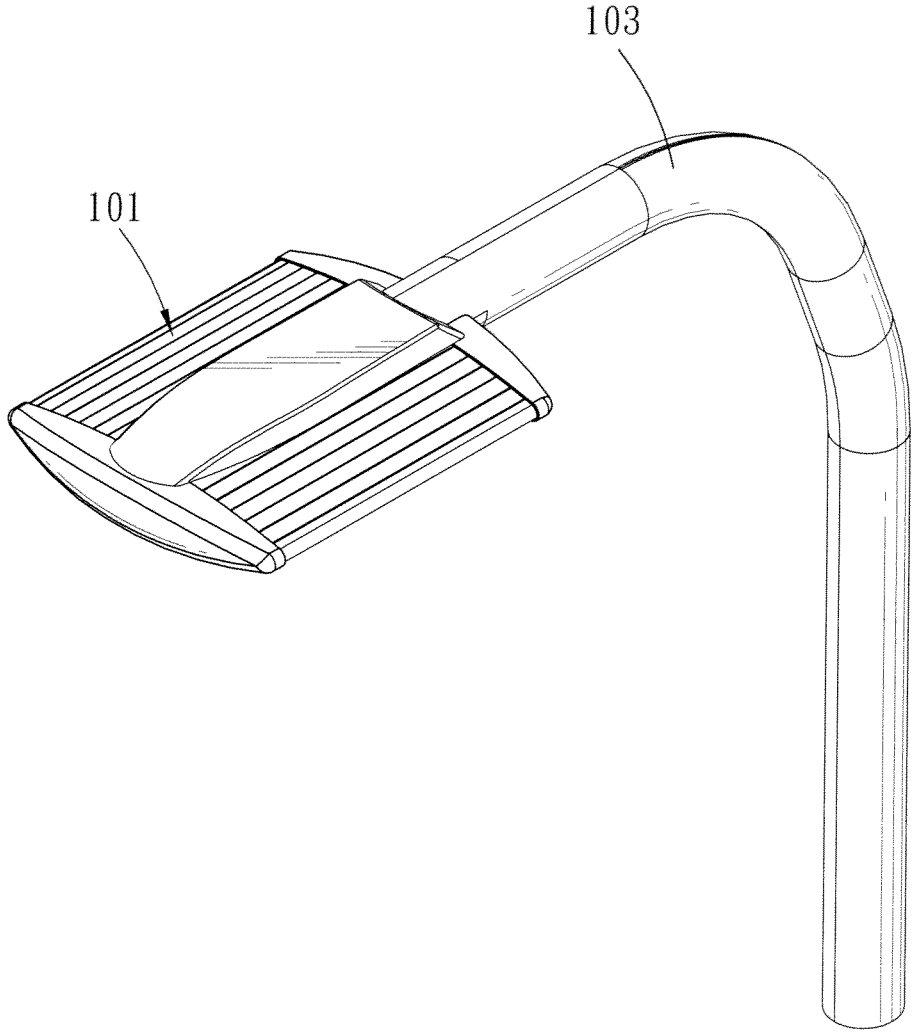
FIG. 2 an assembled perspective view of the first preferred embodiment, illustrating the first preferred embodiment in a state mounted to a lamp post.
Figure 3:
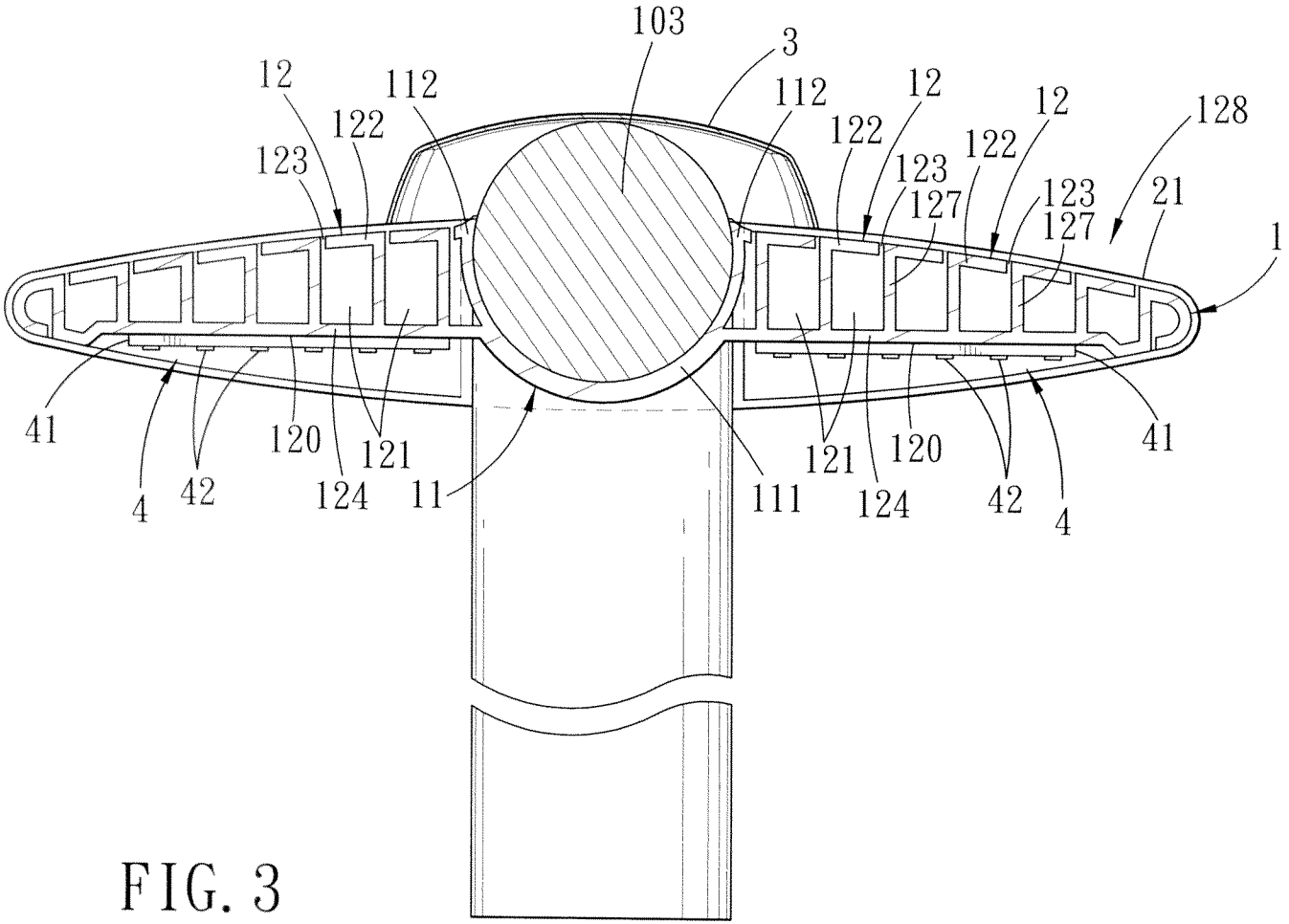
FIG. 3 is a sectional view of the first preferred embodiment.

Referring to FIGS. 1-3, an LED lamp 100 according to a first preferred embodiment of the present invention comprises a lamp seat 101, and a light assembly including a pair of light modules 4 disposed on the lamp seat 101.

The lamp seat 101 includes a heat-dispersing unit 1, a pair of side covers 21, 22, and a top cover 3. The heat-dispersing unit 1 includes a support member 11 and a plurality of tubular members 12. The support member 11 has an elongated, semi-cylindrical structure, and includes a bottom portion 111, and a pair of side portions 112 extending upwardly from opposite sides of the bottom portion 111 to thereby be spaced apart from each other. The cross-sectional view of the support member 11 (see FIG. 3) is such that the side port ions 112 extend upwardly from the bottom portion 111 to form an arc that opens upwardly.

Some of the tubular members 12 are disposed in a side-by-side manner starting from an outer surface of one of the side portions 112 to thereby be arranged on a first side of the support member 11, and the remainder of the tubular members 12 are disposed in a side-by-side manner starting from an outer surface of the other one of the side portions 112 to thereby be arranged on a second side of the support member 11.

In the first preferred embodiment, the heat-dispersing unit 1 is formed by an aluminum extrusion process, such that the support member 11 and the tubular members 12 are formed as a single piece.

Each of the tubular members 12 extends in a horizontal direction and defines a tubular space 121. In this embodiment, each of the tubular members 12 includes a wall assembly 128 having an outer tubular wall 124, an upper tubular wall 122 disposed above and spaced apart from the outer tubular wall 124, and an intermediate tubular wall 127 interconnecting the outer and upper tubular walls 124, 122. The outer tubular walls 124 of the tubular members 12 on each of the first side and the second side of the support member 11 are interconnected to each other to thereby define a substantially planar attachment surface 120.

One of the light modules 4 is mounted on the attachment surface 120 formed by the tubular members 12 arranged on the first side of the support member 11, and the other one of the light modules 4 is mounted on the attachment surface 120 formed by the tubular members 12 arranged on the second side of the support member 11.

In order to minimize costs associated with providing an additional fin structure for heat dissipation, the present invention makes full use of the configuration of the lamp seat 101 (i.e., the tubular members 12 thereof) to function as a heat dissipating structure. In addition to the material of the tubular members 12 themselves conducting heat to the upper tubular walls 122 via the intermediate tubular walls 127, the hollow tubular spaces 121 defined by the tubular members 12 also function to provide a heat-dissipating effect. In greater detail, when heat generated by the light modules 4 is transferred to the attachment surfaces 120 of the tubular members 12, this heat increases the temperature of the air in the tubular spaces 121. However, the air in the tubular spaces 121 at a distance from the light modules 4 or the air in the two ends of the tubular members 12 is not heated, such that a convection effect is formed in the tubular spaces 121. As a result, the heat generated by the light modules 4 is carried away by the convection effect. Hence, heat dissipation is realized without the use of heat dissipating fins in the present invention.

Each of the tubular members 12 is formed with a slit 123 extending in the horizontal direction and spatially communicating with the tubular space 121 thereof. In the first preferred embodiment, the slit 123 formed in the outermost tubular member 12 on each of the first and second sides of the support member 11 are located on a bottom side of the heat-dispersing unit 1, while the slits 123 formed in the remaining tubular members 12 on the first and second sides of the support member 11 are located on a top side of the heat-dispersing unit 1. In this embodiment, except for the outermost tubular member 12 on each of the first and second sides of the support member, each of the tubular members 12 has the structure described above, including the outer tubular wall 124, the upper tubular wall 122 disposed above and spaced apart from the outer tubular wall 124, and the intermediate tubular wall 127 interconnecting the outer and upper tubular walls 124, 122. In this embodiment, the cross section of the upper and intermediate tubular walls 122, 127 of each of these tubular members 12 is L-shaped, as best shown in FIG. 3. In some embodiments, the open slits 123 are not formed in the tubular members 12.

In the first preferred embodiment, heights of the upper tubular walls 122 arranged on each of the first and second sides of the support member 11 gradually decrease as the distance from the support member 11 is increased. As an example, such a configuration may be realized by gradually decreasing the lengths of the intermediate tubular walls 127 on each of the first and second sides of the support member 11 as the distance from the support member 11 is increased therefore, in the first preferred embodiment, the upper tubular walls 122 of the tubular members 12 on either one of the first and second sides of the support member 11 form a downward slanting surface in a direction away from the support member 11.

Each of the side covers 21, 22 includes a side wall 211, 221 and a surrounding wall 212, 222 extending from a periphery of the side wall 211, 221. The side wall 211, 221 and the surrounding wall 212, 222 of each side cover 21, 22 define a receiving space 213, 223. Each of the side covers 21, 22 is sleeved on opposite ends of the heat-dispersing unit 1 in the horizontal direction. That is, in the horizontal direction, the support member 11 and the tubular members 12 form opposite ends of the heat-dispersing unit 1, and the side covers 21, 22 are sleeved respectively thereon. The receiving space 213, 223 of each side cover 21, 22 may be sized such that the side cover 21, 22 is securely connected to the heat-dispersing unit 1 when sleeved thereon. In some embodiments, the side covers 21, 22 may be omitted from the configuration of the lamp seat 101 of the LED lamp 100.

The top cover 3 is connected to the heat-dispersing unit 1 to thereby form a space between the top cover 3 and the heat-dispersing unit 1. The space is adapted to receive a lamp post 103 therein, such that the entire LED lamp 100 is connected to the lamp post 103, as shown in FIG. 2. In some embodiments, the top cover 3 is secured to the heat-dispersing unit 1 using fasteners, such as screws. Moreover, in some embodiments, the space between the top cover 3 and the heat-dispersing unit 1 is further used to accommodate electronic components (e.g., a driver circuit; not shown) that are electrically connected to the light modules 4.

Each of the light modules 4 includes a substrate 41, and a plurality of LED elements 42 disposed on a bottom surface of the substrate 41. In some embodiments, the substrate 41 is an aluminum substrate covered with a copper foil circuit. The LED elements 42 may be light-emitting chips. As described above, the light modules 4 are mounted respectively on the attachment surfaces 120 formed by the tubular members 12 arranged on the first and second sides of the support member 11. In this mounting state, the LED elements 42 face downwardly, such that the light emitted by the LED elements 42 is projected in the same direction.

Figure 4:
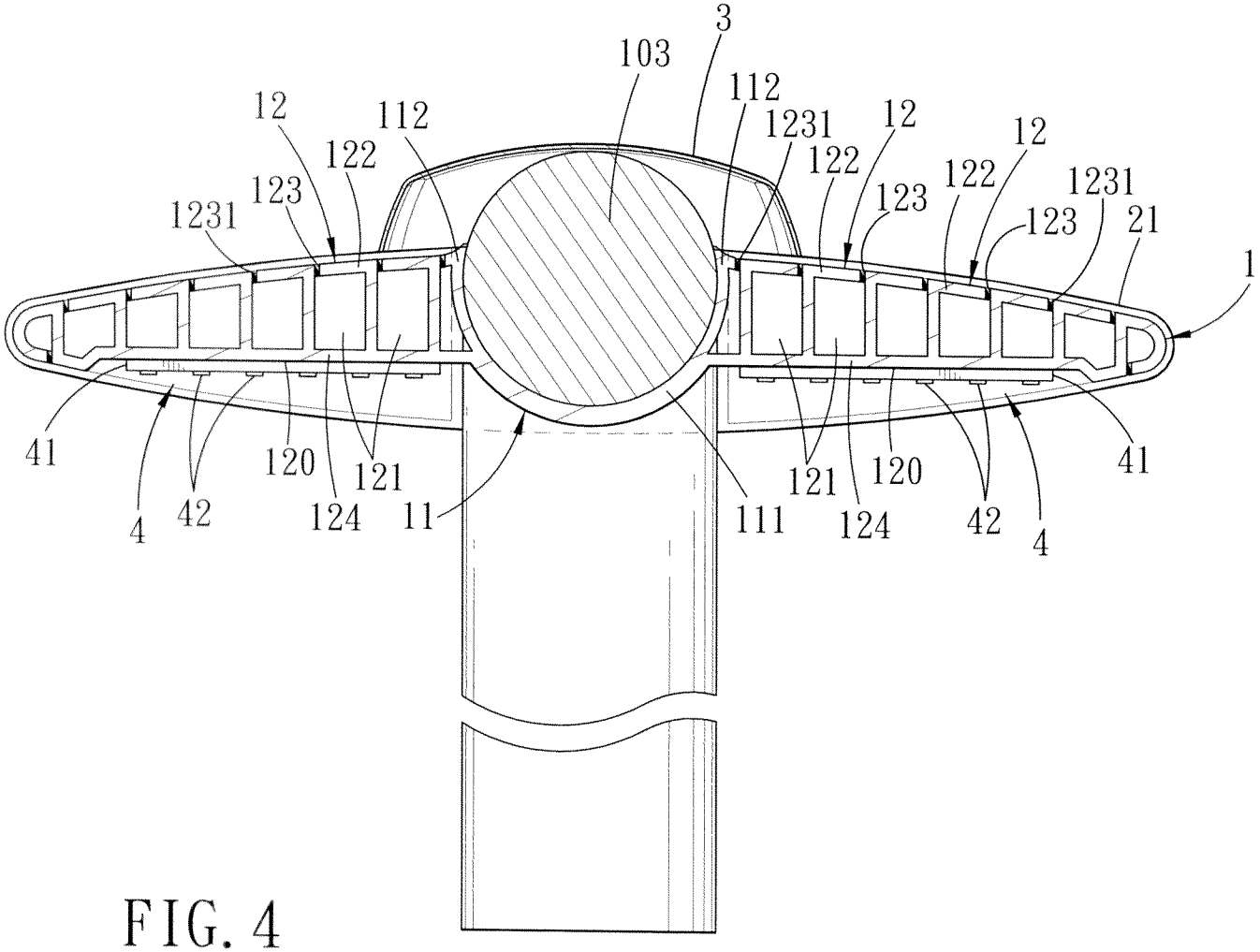
FIG. 4 is a fragmentary sectional view of the first preferred embodiment, illustrating a filler material inserted into slits formed in tubular members.

Referring to FIG. 4, in some embodiments, a filler material 1231 is filled in the slits 123. The filler material 1231 can prevent rainwater, dirt, dust, etc. from entering the tubular spaces 121. The filler material 1231 may be made of a thermally conductive material.

Figure 5:
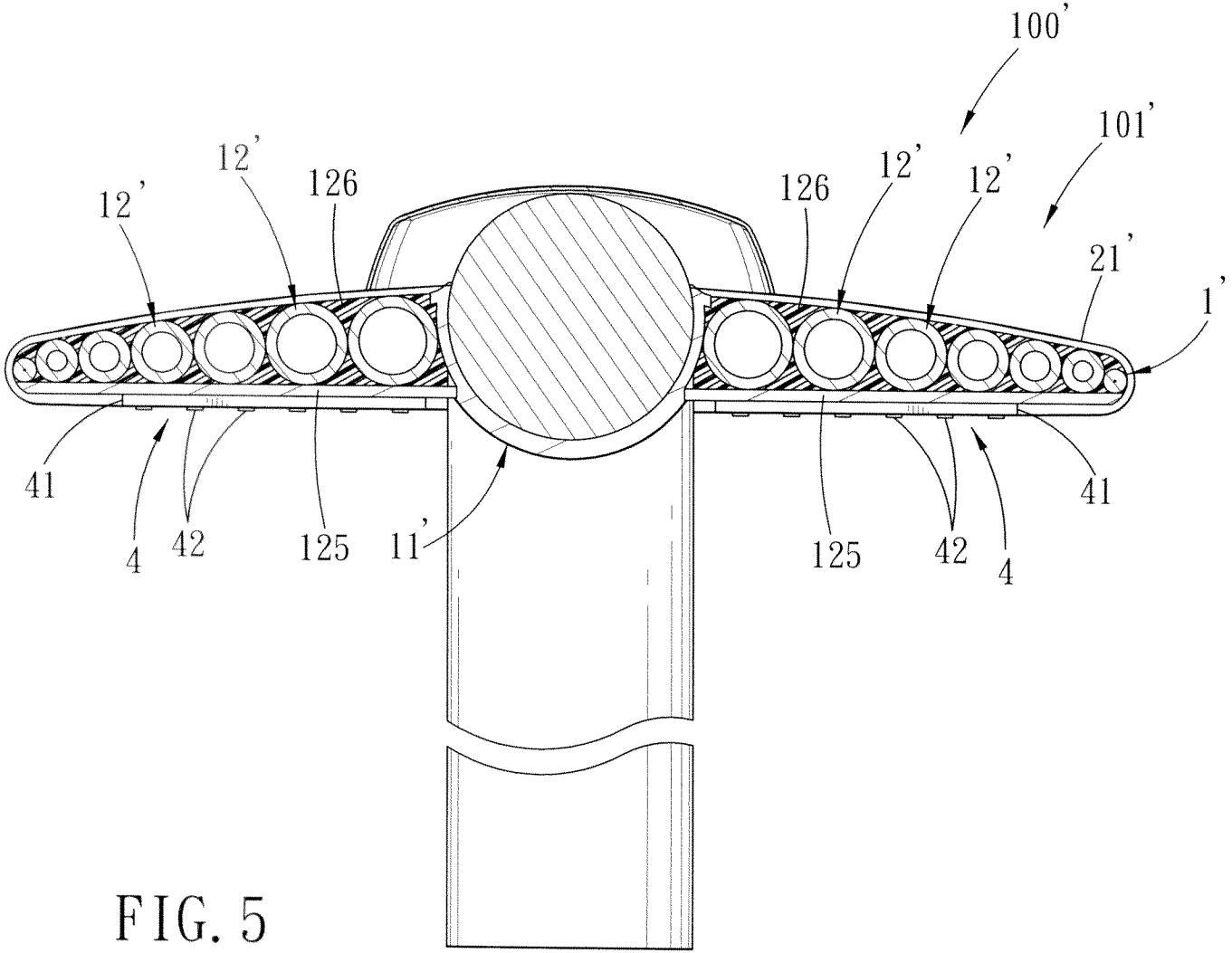
FIG. 5 is a sectional view of an LED lamp according to a second preferred embodiment of the present invention.

Referring to FIG. 5, an LED lamp 100' according to a second preferred embodiment of the present invention will now be described. The LED lamp 100' of the second preferred embodiment differs from that of the first preferred embodiment in the manner outlined below.

Each of the tubular members 12' of the neat-dispersing unit 1 is an individually formed tube-like structure with a circular cross section, a plurality of the tubular members 12' are arranged in a side-by-side manner on each of the first and second sides of the support member 11'. The tubular members 12' may have the same diameter or different diameters. In this embodiment, the tubular members 12' have different diameters. That is, in this embodiment, the diameters of the tubular members 12' arranged on each of the first and second sides of the support member 11' gradually decrease as the distance from the support member 11 is increased.

Moreover, in this embodiment, the lamp seat 101' may further include a pair of load-bearing plates 125 (e.g., aluminum plates) disposed respectively on the first and second sides of the support member 11'. The tubular members 12' arranged side-by-side on the first or second side of the support member 11' are disposed on an upper surface of one of the load-bearing plates 125, and the corresponding light module 4 is disposed on an outer surface of the same load-bearing plate 125. Since the tubular members 12' are provided as individually formed tube-like structures, as described above, in addition to being maintained in their side-by-side configuration through ends thereof being inserted in the side covers 21', 22' (only the side cover 21' is shown in FIG. 5), glue (for example, thermally conductive glue; not shown) may be applied between the tubular members 12' to help maintain the same in their side-by-side arrangement. Alternatively or additionally, an engagement structure (not shown), such as hook-and-loop fasteners, buttons, two-sided tape, etc., may be provided between the tubular members 12' to help maintain the same in their side-by-side arrangement.

Moreover, to realize an improved heat dissipation effect, a thermally conductive material 126, such as a thermally conductive glue, may be filled in the spaces between the tubular members 12'.

Figure 6:
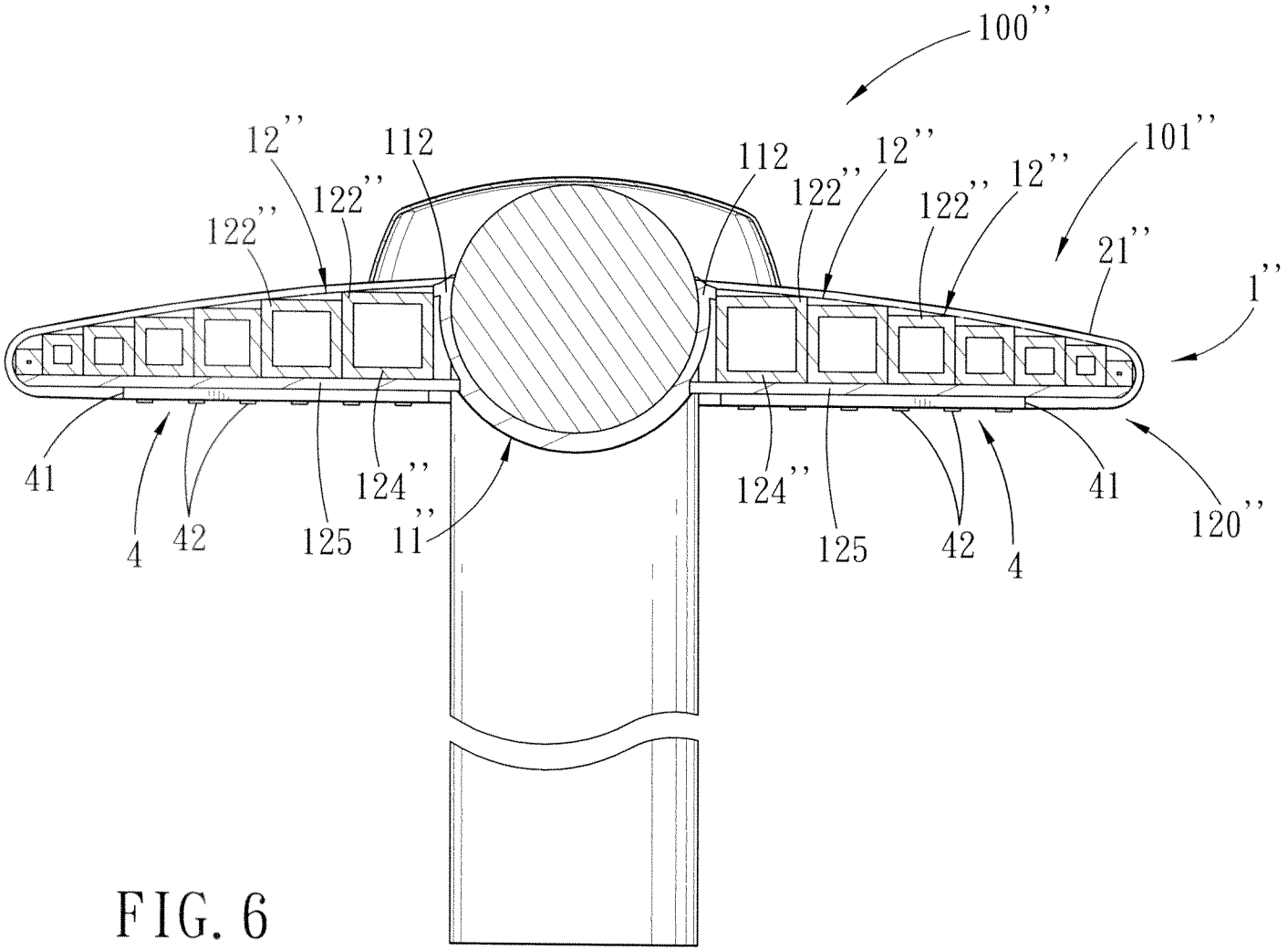
FIG. 6 is sectional view of a modified example of the second preferred embodiment.

FIG. 6 shows a modified example of the heat-dispersing unit 1' of the second preferred embodiment. This modified example differs from the second preferred embodiment in that the tubular members 12" of the heat-dispersing unit 1" have a rectangular cross section. In this embodiment, distances between opposing upper and outer walls 122", 124" of the tubular members 12" arranged on each of the first and second sides of the support member 11 gradually decrease as the distance from the support member 11" is increased. As a result, the upper tubular walls 122" of the tubular members 12" on each of the first and second sides of the support member 11" are formed in a stepped configuration with a height that gradually decreases in a direction away from the support member 11".

In the modified example of FIG. 6, since the tubular members 12" are formed as rectangular tubes, the light module 4 on each of the first and second sides of the support member 11" may, alternatively, be disposed on the planar attachment surface 120 formed by the outer tubular walls 124" of the tubular members 12". Hence, in the modified example of FIG. 6, the load-bearing plates 125 may be omitted from the configuration of the lamp seat 101".

As in the case of the embodiment shown in FIG. 5, in this embodiment, in addition to being maintained in their side-by-side configuration through ends thereof being inserted in the side covers 21", 22" (only the side cover 21" is shown in FIG. 6), glue (for example, thermally conductive glue; not shown) may be applied between the tubular members 12" to help maintain the same in their side-by-side arrangement. Alternatively or additionally, an engagement structure (not shown), such as hook-and-loop fasteners, buttons, two-sided tape, etc., may be provided between the tubular members 12" to help maintain the same in their side-by-side arrangement.

It is to be noted that in the embodiments of the present invention, reference to the light modules 4 as being mounted "on" the tubular members 12, 12', 12" may mean that the light modules 4 are mounted directly on the tubular members 12 (see FIG. 3), or indirectly on the tubular members 12', 12" with an intervening element, i.e., the load-bearing plate 125 interposed therebetween (see FIGS. 5 and 6).

In the LED lamp 100, 100', 100" of the present invention described above, the tubular members 12, 12', 12" provide a heat-dissipating effect such that an additional fin structure need not be included in the configuration of the present invention. Hence, costs are minimized. In the case of the LED lamp 100 of the first preferred embodiment and the LED lamp 100" of the modified example of the second preferred embodiment, the tubular members 12, 12" further provide attachment surfaces 120, 120" for the light modules 4, such that the tubular members 12, 12" have a dual purpose and thereby further reduce costs.

In addition, regardless of whether the heat-dispersing unit 1, 1', 1" is formed as a single piece through an aluminum extrusion process as shown in FIG. 3 or formed through a tube-like structure of the tubular members 12', 12" as shown in FIGS. 5 and 6, only use of the top cover 3 and the side covers 21, 22, 21', 22', 21", 22" is needed to complete assembly of the LED lamp 100, 100', 100". Hence, assembly is made is easy in the present invention.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An LED lamp, comprising:

a lamp seat including a heat-dispersing unit having a plurality of tubular members disposed side-by-side, each of said tubular members including a wall assembly surrounding a tubular space; said wall assembly of each of said tubular members has an outer tubular wall, said outer tubular walls of said tubular members cooperating to form a substantially planar attachment surface; said wall assembly of each of said tubular members further has an upper tubular wall disposed above and spaced apart from said outer tubular wall thereof;

a light assembly including a light module having an LED element, said light module being mounted on said tubular members of said heat-dispersing unit; said light module being mounted on said attachment surface; and a pair of side covers, each of said side covers defining a receiving space, each of said side covers being sleeved on opposite ends of said plurality of tubular members using said receiving space.

2. The LED lamp of claim 1, wherein said outer tubular walls of said tubular members are interconnected.

3. The LED lamp of claim 1, wherein said wall assembly of each of said tubular members further has an intermediate tubular wall interconnecting said upper tubular wall and said outer tubular wall thereof.

4. The LED lamp of claim 1, wherein: said heat-dispersing unit further has a support member, said support member having a bottom portion, and a pair of side portions extending upwardly from opposite sides of said bottom portion to thereby be spaced apart from each other; some of said tubular members are disposed in a side-by-side manner starting from an outer surface of one of said side portions to thereby be arranged on a first side of said support member, and the remainder of said tubular members being disposed in a side-by-side manner starting from an outer surface of the other one of said side portions to thereby be arranged on a second side of said support member; and said light assembly includes a pair of said light modules, one of said light modules being mounted on said tubular members arranged on said first side of said support member, and the other one of said light modules being mounted directly or indirectly on said tubular members arranged on said second side of said support member.

5. The LED lamp of claim 4, wherein heights of said upper tubular walls of said tubular members arranged on each of said first and second sides of said support member gradually decrease as a distance from said support member is increased.

6. The LED lamp of claim 1, wherein said heat-dispersing unit is formed by an aluminum extrusion process, each of said tubular members being formed with a slit extending in a direction and spatially communicating with said tubular space thereof.

7. The LED lamp of claim 6, wherein a filler material is filled in said slits.

8. The LED lamp of claim 1, wherein each of said side covers includes a side wall and a surrounding wall extending from a periphery of said side wall, said side wall and said surrounding wall defining the receiving space.

9. The LED lamp of claim 1, wherein:

said heat-dispersing unit further has a support member, said support member having a bottom portion, and a pair of side portions extending upwardly from said bottom portion on opposite sides thereof to thereby be spaced apart from each other;

some of said tubular members are disposed in a side-by-side manner starting from an outer surface of one of said side portions of said support member to thereby be arranged on a first side of said support member, and the remainder of said tubular members being disposed in a side-by-side manner starting from an outer surface of the other one of said side portions to thereby be arranged on a second side of said support member; and said LED lamp comprises a pair of said light modules mounted on said tubular members arranged on said first side of said support member and said second side of said support member, respectively.

10. The LED lamp of claim 9, wherein each of said tubular members is an individually formed tube-like structure with a circular or rectangular cross section, diameters of said tubular members arranged on each of said first and second sides of said support member when said tubular members have circular cross sections gradually decreasing as a distance from said support member is increased, distances between opposing upper and outer walls of said tubular members arranged on each of said first and second sides of said support member when said tubular members have a rectangular cross section gradually decreasing as a distance from, said support member is increased.

11. An LED lamp, comprising:

a lamp seat including a heat-dispersing unit having a plurality of tubular members disposed side-by-side, each of said tubular members including a wall assembly surrounding a tubular space;

a light assembly including a light module having an LED element, said light module being mounted on said tubular members of said heat-dispersing unit; and a pair of side covers, each of said side covers defining a receiving space, each of said side covers being sleeved on opposite ends of said plurality of tubular members using said receiving space;

wherein said heat-dispersing unit is formed by an aluminum extrusion process, each of said tubular members being formed with a slit extending in a horizontal direction and spatially communicating with said tubular space thereof, and a filler material is filled in said slits.

12. An LED lamp, comprising:

a lamp seat including a heat-dispersing unit having a plurality of tubular members disposed side-by-side, each of said tubular members including a wall assembly surrounding a tubular space;

a light assembly including a light module having an LED element, said light module being mounted on said tubular members of said heat-dispersing unit; and a pair of side covers, each of said side covers defining a receiving space, each of said side covers being sleeved on opposite ends of said plurality of tubular members using said receiving space, wherein:

said heat-dispersing unit further has a support member, said support member having a bottom portion, and a pair of side portions extending upwardly from said bottom portion on opposite sides thereof to thereby be spaced apart from each other;

some of said tubular members are disposed in a side-by-side manner starting from an outer surface of one of said side portions of said support member to thereby be arranged on a first side of said support member, and the remainder of said tubular members being disposed in a side-by-side manner starting from an outer surface of the other one of said side portions to thereby be arranged on a second side of said support member; and said LED lamp comprises a pair of said light modules mounted on said tubular members arranged on said first side of said support member and said second side of said support member, respectively.

13. The LED lamp of claim 12, wherein each of said tubular members is an individually formed tube-like structure with a circular or rectangular cross section, diameters of said tubular members arranged on each of said first and second sides of said support member when said tubular members have circular cross sections gradually decreasing as a distance from said support member is increased, distances between opposing upper and outer walls of said tubular members arranged on each of said first and second sides of said support member when said tubular members have a rectangular cross section gradually decreasing as a distance from, said support member is increased.

* * * * *